US009580909B2

(12) United States Patent
Hostetler et al.

(10) Patent No.: US 9,580,909 B2
(45) **Date of Patent: *Feb. 28, 2017**

(54) SYSTEM FOR ENHANCING THE THERMAL RESISTANCE OF ROOFS AND WALLS OF BUILDINGS

(71) Applicant: BlueScope Buildings North America, Inc., Kansas City, MO (US)

(72) Inventors: William Hostetler, Grandview, MO (US); Tori Johnson, Lee's Summit, MO (US); Cliff Robinson, Blue Springs, MO (US); Richard Grabmeier, Shawnee, KS (US)

(73) Assignee: Bluescope Buildings North America, Inc., Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/935,989

(22) Filed: Nov. 9, 2015

(65) Prior Publication Data

US 2016/0237687 A1 Aug. 18, 2016

Related U.S. Application Data

(60) Provisional application No. 62/117,214, filed on Feb. 17, 2015.

(51) Int. Cl.

| | |
|---|---|
| ***E04C 1/00*** | (2006.01) |
| ***E04D 3/36*** | (2006.01) |
| ***E04D 3/361*** | (2006.01) |
| ***E04D 3/367*** | (2006.01) |
| ***E04D 13/16*** | (2006.01) |

(52) U.S. Cl.
CPC ..... *E04D 3/3602* (2013.01); *E04D 3/361* (2013.01); *E04D 3/364* (2013.01); *E04D 13/1618* (2013.01); *E04D 2003/3615* (2013.01)

(58) Field of Classification Search
CPC . E04D 3/3601; E04D 3/16; E04B 1/76; E04B 2001/405
USPC ..... 52/309.1, 407.1, 478, 408, 409, 410
See application file for complete search history.

(56) References Cited

U.S. PATENT DOCUMENTS

| | | | |
|---|---|---|---|
| 4,058,949 | A | 11/1977 | Bellem |
| 4,081,938 | A | 4/1978 | Bertacchi et al. |
| 4,391,075 | A | 7/1983 | Musgrave |
| 4,516,371 | A | 5/1985 | Simpson |
| 4,642,961 | A | 2/1987 | Cruise |

(Continued)

OTHER PUBLICATIONS

PCT/US2016/018259 Search Report and Written Opinion dated Jun. 23, 2016, 12 pages.

*Primary Examiner* — Basil Katcheves
(74) *Attorney, Agent, or Firm* — Lathrop & Gage L.L.P.

(57) ABSTRACT

A system for insulating a building comprising a first layer of rolled insulation disposed atop a longitudinally extending upper chord of a roof truss, a purlin or a girt of a wall. Discrete insulating spacer members are intermittently disposed atop the first insulation layer and along the longitudinally extending chord, purlin or girt. A three sided bridge with a plurality of tab elements overlaying and contiguous with the insulating spacer members. A second layer of rolled insulation disposed atop the bridge and panel clips secured with a fastener extending through each of the second layer of insulation, bridge, insulating spacer member, first layer of insulation and upper chord.

10 Claims, 9 Drawing Sheets

(56) References Cited

U.S. PATENT DOCUMENTS

| | | | | |
|---|---|---|---|---|
| 4,651,489 | A | 3/1987 | Hodges et al. | |
| 5,408,797 | A | 4/1995 | Bellem et al. | |
| 5,911,663 | A | 6/1999 | Eidson | |
| 6,233,894 | B1 | 5/2001 | Abney et al. | |
| 8,316,605 | B2 | 11/2012 | Oberg | |
| 8,371,083 | B2 | 2/2013 | Chamberlin et al. | |
| 8,621,805 | B2 | 1/2014 | McClure | |
| 8,627,628 | B2 | 1/2014 | McClure | |
| 8,661,763 | B2 | 3/2014 | Oberg | |
| 8,713,884 | B2 | 5/2014 | Musick et al. | |
| 2003/0167718 | A1* | 9/2003 | Alderman | E04D 13/1618 52/407.3 |
| 2008/0083183 | A1* | 4/2008 | Rymell | E04D 3/3608 52/408 |
| 2012/0255252 | A1 | 10/2012 | McClure | |

* cited by examiner

SYSTEM FOR ENHANCING THE THERMAL RESISTANCE OF ROOFS AND WALLS OF BUILDINGS

RELATED APPLICATIONS

This application claims the benefit of priority to U.S. Application No. 62/117,214 filed on Feb. 17, 2015.

TECHNICAL FIELD

This disclosure relates generally to the field of insulating roof and wall structures and related methods. More specifically, the disclosure relates to the field of insulating metal roofed and metal walled structures in both new and retrofit construction.

BACKGROUND

For decades insulation has been used in metal buildings to retard thermal transfer through the roof as well as the wall structures. Typical roof and wall insulation configurations use blanket insulation. The thermal resistance offered by the insulation is compromised when it is compressed or packed down. In conventional metal roof and wall insulation systems, when the roof structure is applied to the tops of the roof purlins, or the wall structure is applied to the gifts, the thick layer of blanket insulation is compressed, thus reducing the thermal resistance of the insulation system. In some areas of the conventional roof and wall systems, the compression of the insulation is so severe that a thermal short is created, thus substantially degrading the insulation properties of the insulation system.

The above references to the background art do not constitute an admission that the art forms part of the common general knowledge of a person of ordinary skill in the art. The above references are not intended to limit the application of insulating systems as disclosed herein.

SUMMARY

According to a first aspect, the present disclosure provides a system for insulating roofs and walls, the insulating system include a first layer of rolled insulation disposed atop a longitudinally extending roof purlin upper chord of a roof truss or wall girt. Disposed atop the first layer of insulation are discrete insulating bridge blocks or brackets, also referred to as spacer members, intermittently disposed atop the first insulating layer and along the longitudinally extending upper chord. Atop the insulating bridge blocks or brackets is a supplemental insulating element continuous with the longitudinally extending upper chord disposed atop the intermittently disposed insulating bridge blocks or brackets. Adjacent the supplement insulating element is a bridge that may include a plurality of upwardly extending tab elements, the bridge overlaying and contiguous with the supplemental insulating element.

A second layer of rolled insulation disposed atop and contiguous with the bridge is then interwoven into the roof insulating structure. A plurality of panel clips are then secured with fasteners through each of the second layer of insulation, bridge, supplemental insulating element, discrete bridge blocks or brackets, first layer of insulation and upper chord, the panel clips being intermittently disposed along the longitudinally extending upper chord.

A comparable configuration of insulating elements including layered insulation, discrete spacer members and a plurality of panel clips or fasteners are utilized to secure a wall panel to horizontally spaced building girts thereby providing a system that eliminates thermal transfer short circuits in the walls. Likewise, this disclosed configuration may also be utilized to retrofit an existing roof or wall structure with only slight modification.

BRIEF DESCRIPTION OF THE DRAWINGS

The foregoing and other features and advantages will be apparent from the more particular description of preferred embodiments, as illustrated in the accompanying drawings, in which like reference characters refer to the same parts throughout the different views. The drawings are not necessarily to scale; the sizes of elements may be exaggerated for clarity.

DETAILED DESCRIPTION

Figure 1:
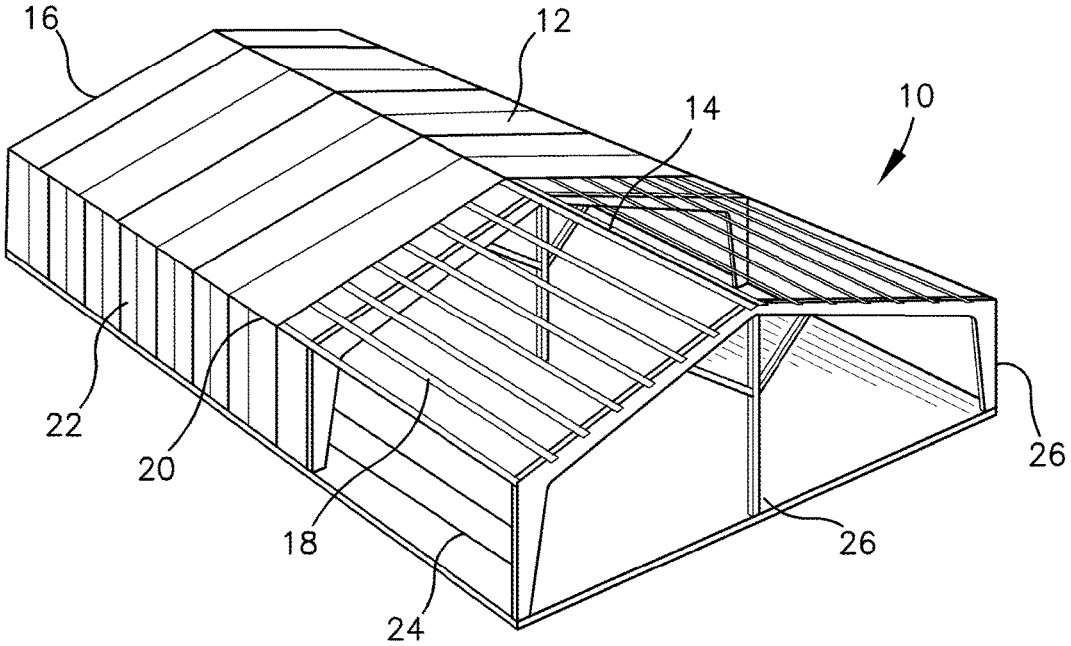
FIG. 1 is a perspective view with portions broken away of a metal building structure of a type for which the insulated metal roof structure of the present disclosure is suitable.

A building roof and wall insulating system 10, as seen in FIG. 1, comprises the installation of insulating elements within the roof and wall structural features of a building 12. A roof structure 14 including roof decking or sheeting 16 that are supported by purlins 18. Purlins are structural members in a roof that span parallel to the building eave 20, and support the roof decking or sheeting 16. Sandwiched between the purlins 18 and the roof decking 16 are insulating elements, of various embodiments, that will be described in greater detail below.

The insulating system 10 detailed herein is equally applicable to insulating a wall panel 22 of a building 12 to limit the transfer of heat. The structural features disclosed herein may also be utilized to retrofit an existing roof or wall to enhance the thermal resistance of the building. Supporting the wall panels 22 are girts 24 that work in conjunction with columns 26 and the wall panels 22. The girts 24 are horizontal structural members in a framed wall that provide lateral support to the wall panels 22, primarily to resist wind loads and to assist in the attachment of the wall panels 22.

Figure 2:
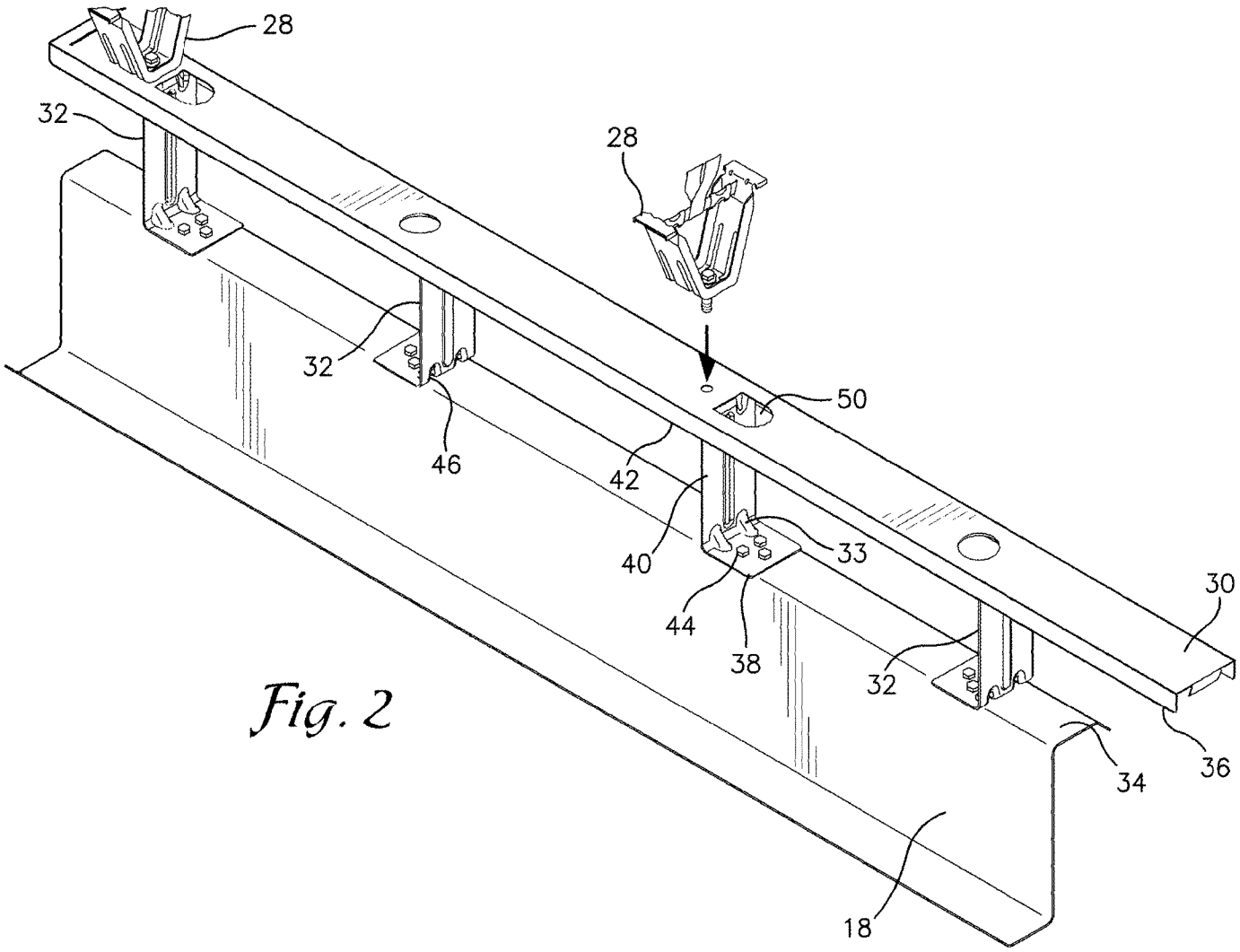
FIG. 2 is a perspective view of an embodiment of the disclosed insulating system disposed atop a purlin.
Figure 10:
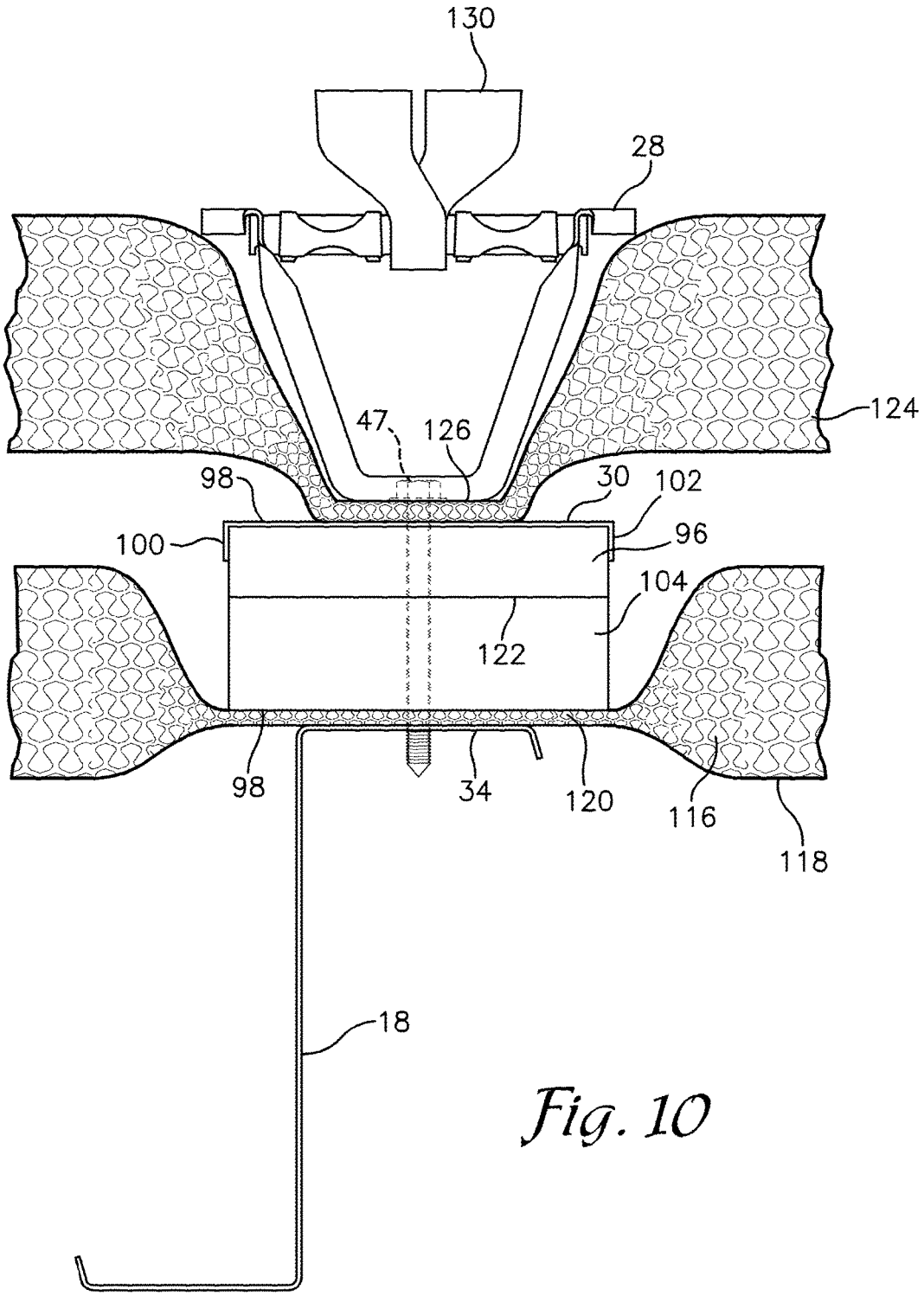
FIG. 10 is a cross sectional view of an embodiment of the disclosed insulating system.
Figure 11:
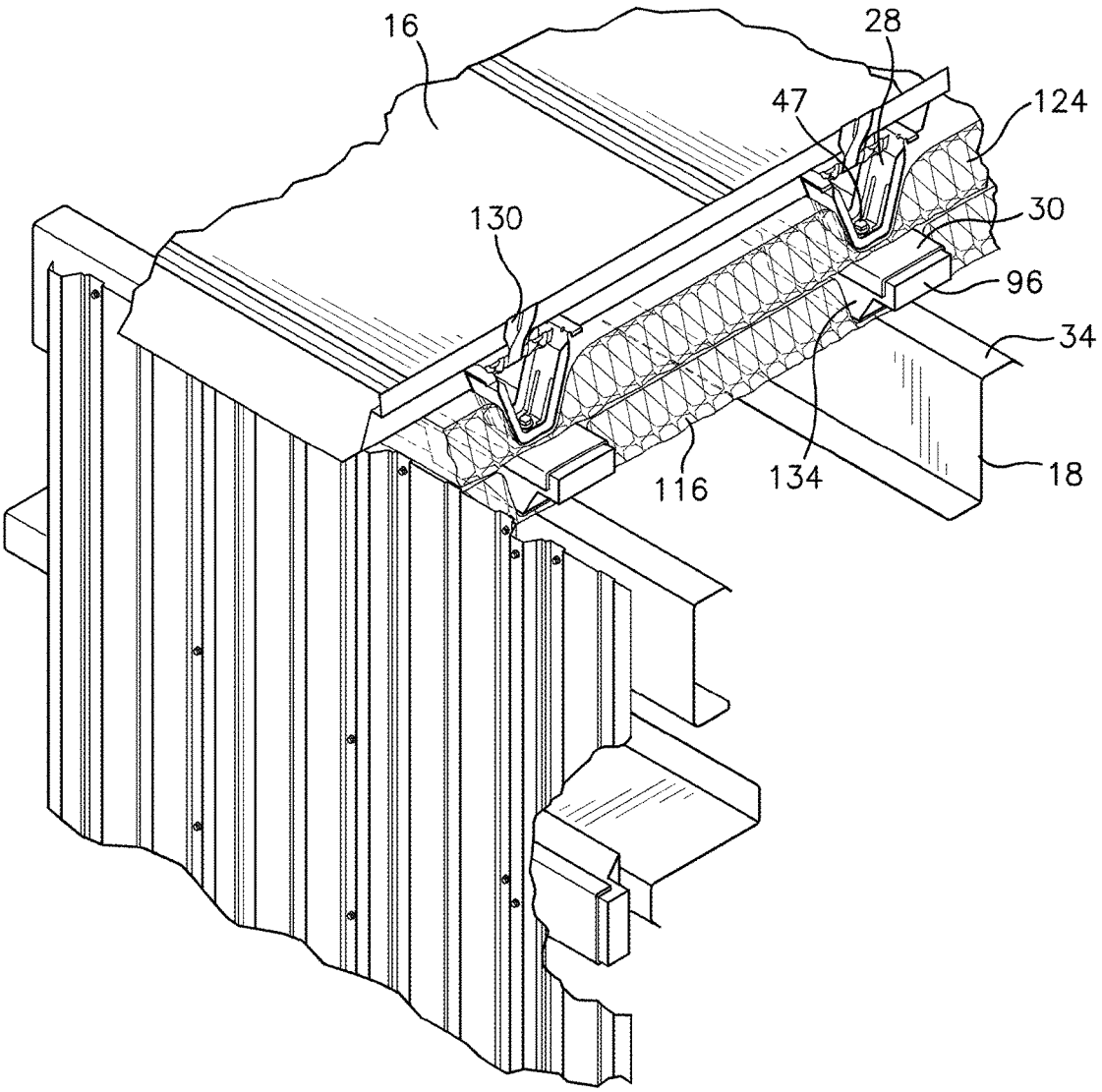
FIG. 11 is a perspective view of an embodiment of the disclosed insulating system.

FIG. 2 illustrates a first embodiment of a purlin 18 mounted insulating system 10 without including the installation of the insulating material. FIG. 2 provides a view, without rolled insulation in place, of the components used to mount the roof clip 28 to the metal bridge 30 and the bridge in turn to the purlin 18. As previously noted, the purlin 18 is a longitudinally extending horizontal structural member in a roof system. Secured to the upper horizontal flange 34 of the purlin 18 is an embodiment of a bracket 32, also generically referred to as a spacer member, that separates the metal bridge 30 by a specified distance from the upper horizontal flange 34 of the purlin 18. The separation distance provided by the bracket, or spacer member, provides an open space for uncompressed rolled insulation thereby maximizing the thermal efficiency of the insulating elements. When fully installed, two layers of insulation will be incorporated as shown in FIGS. 10 and 11.

The brackets 32 may be fabricated in varying heights to accommodate different thicknesses of insulation that are positioned between the bottom 36 of the metal bridge 30 and the upper horizontal flange 34 of the purlin 18. In colder climates it may be preferred to increase the thickness of the insulation and therefore taller brackets 32 may be employed to accommodate the increased thickness.

Figure 13:
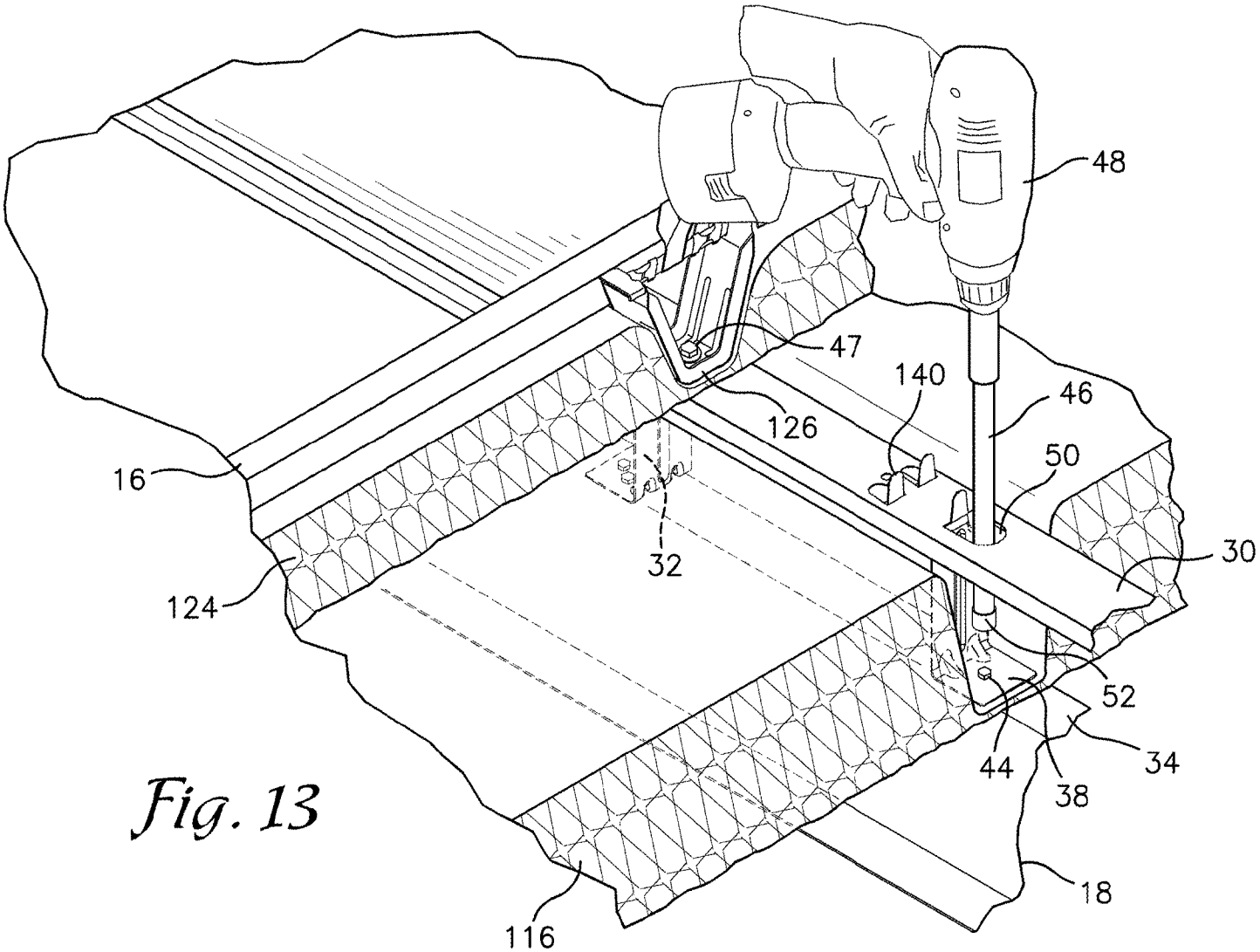
FIG. 13 is a perspective view of a partial embodiment of the disclosed insulating system.

As seen in FIG. 2 the bracket 32 is a Z-shaped component with a lower flange 38, a connecting span 40 and an upper flange 42 (obscured beneath the metal bridge 30). The lower flange 38 includes at least one through hole, and preferably several, allowing for threaded attachments 44 to pass through the lower flange and into the upper horizontal flange 34 of the purlin 18. The procedure for attaching the lower flange 38 of the bracket 32 to the upper flange of the purlin 18 is best seen in FIG. 13. In that Figure, an extension 46 on an electric drill 48 passes through a cutout 50 in the bridge 30 to allow the socket 52 to engage the threaded attachment 44 and to draw the threaded attachments 44 down tight against lower flange 38, the first layer of insulation 116 (causing local deformation of the rolled insulation) and the upper horizontal flange 34 of the purlin 18. Once the nut 44 is fully tightened, the socket and extension 46 are withdrawn back through the cutout. Prior to installing the metal bridge 30 in position atop the purlin 18 the upper flange 42 is secured to the metal bridge 30 with a plurality of threaded fasteners, or alternatively, the upper flange 42 is connected to the bridge 30 at the factory during fabrication by welding or by other means of mechanical fastening. As seen in FIG. 2, all bracket 32 designs preferably utilize one or more stiffener gussets 33 stamped into the bracket material at the junction of the connecting member 40 and the upper and lower flanges 42, 38.

Figure 3:
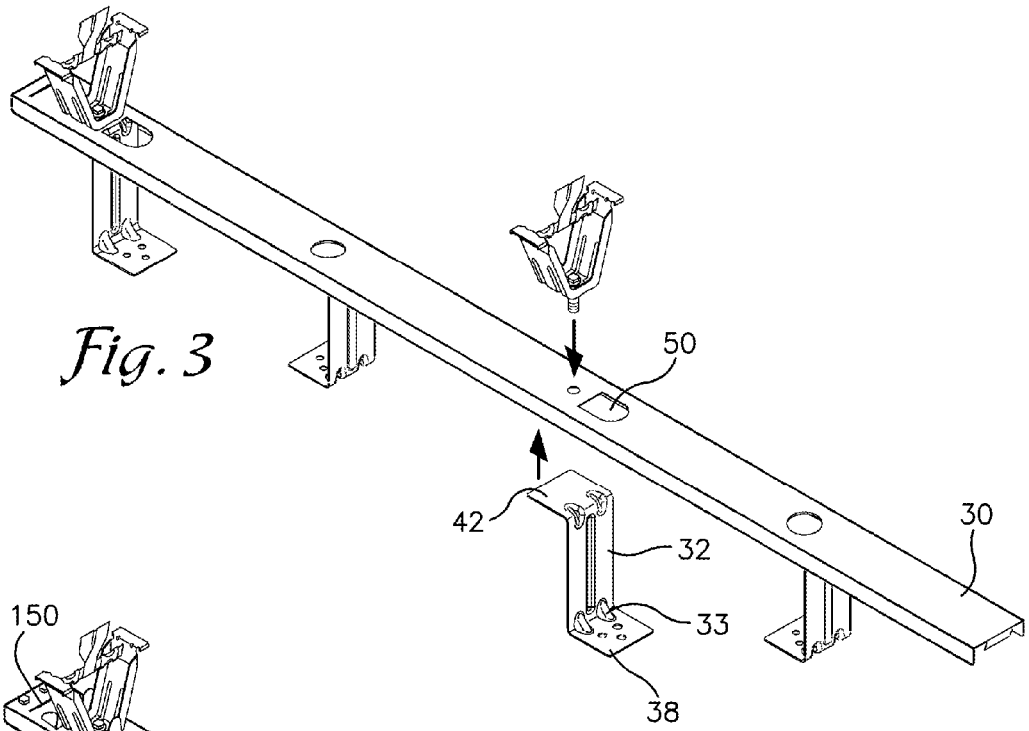
FIG. 3 a perspective view of components of an embodiment of the disclosed insulating system.
Figure 4:
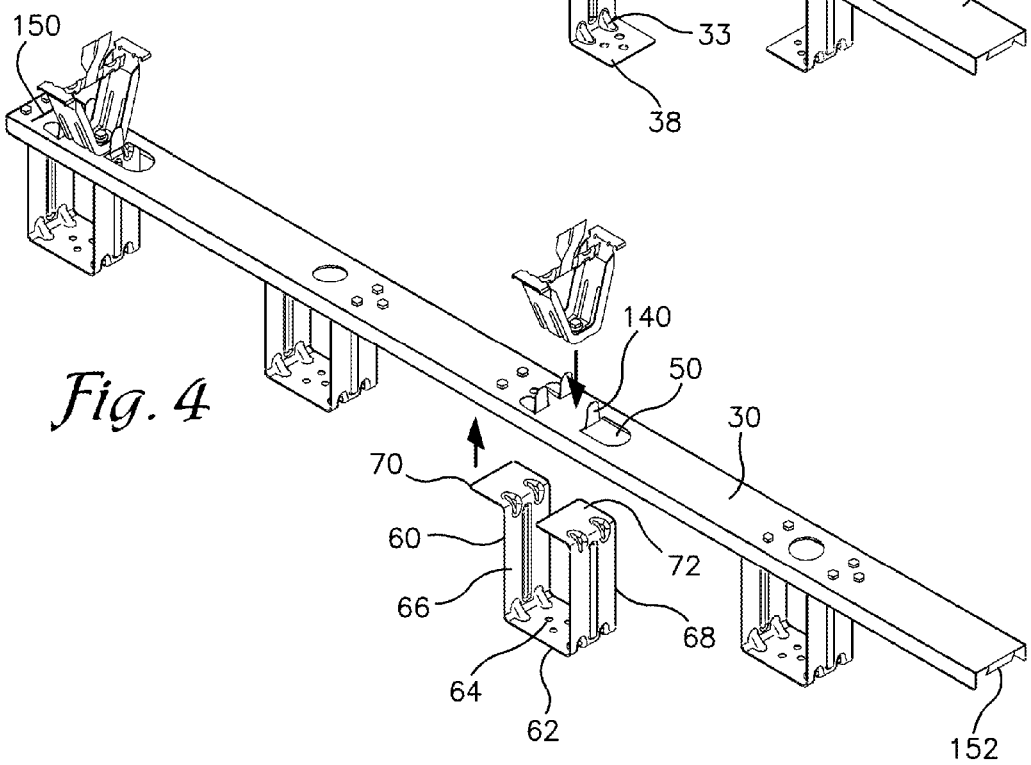
FIG. 4 a perspective view of components of an embodiment of the disclosed insulating system.
Figure 5:
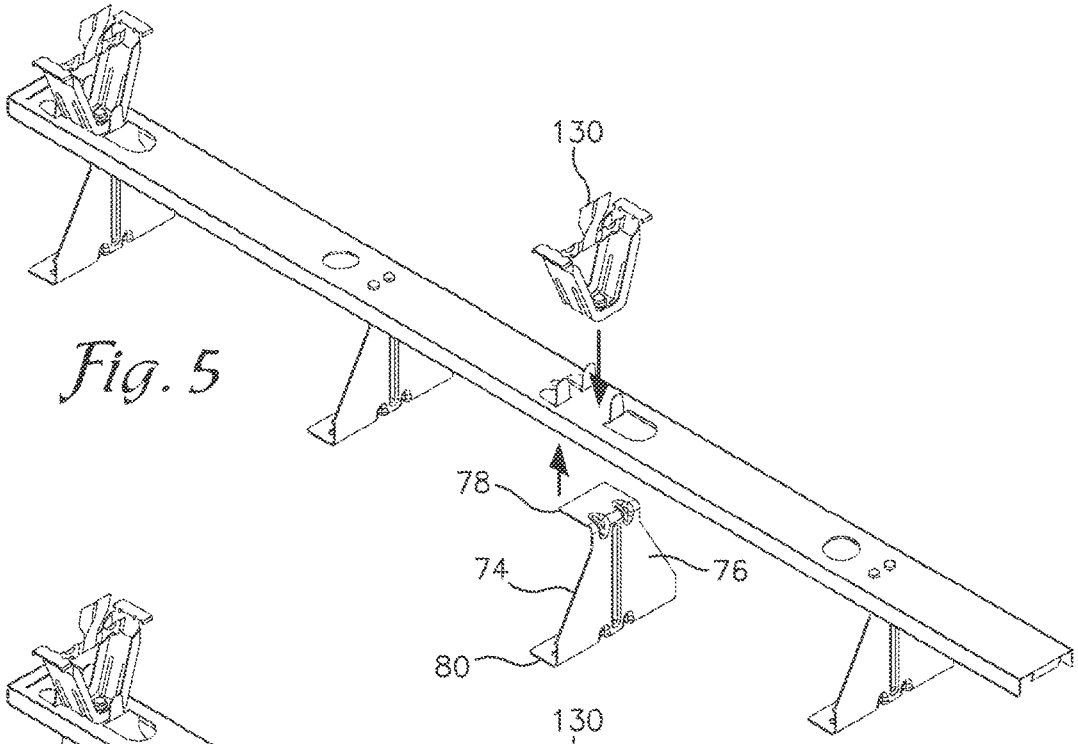
FIG. 5 a perspective view of components of an embodiment of the disclosed insulating system.
Figure 6:
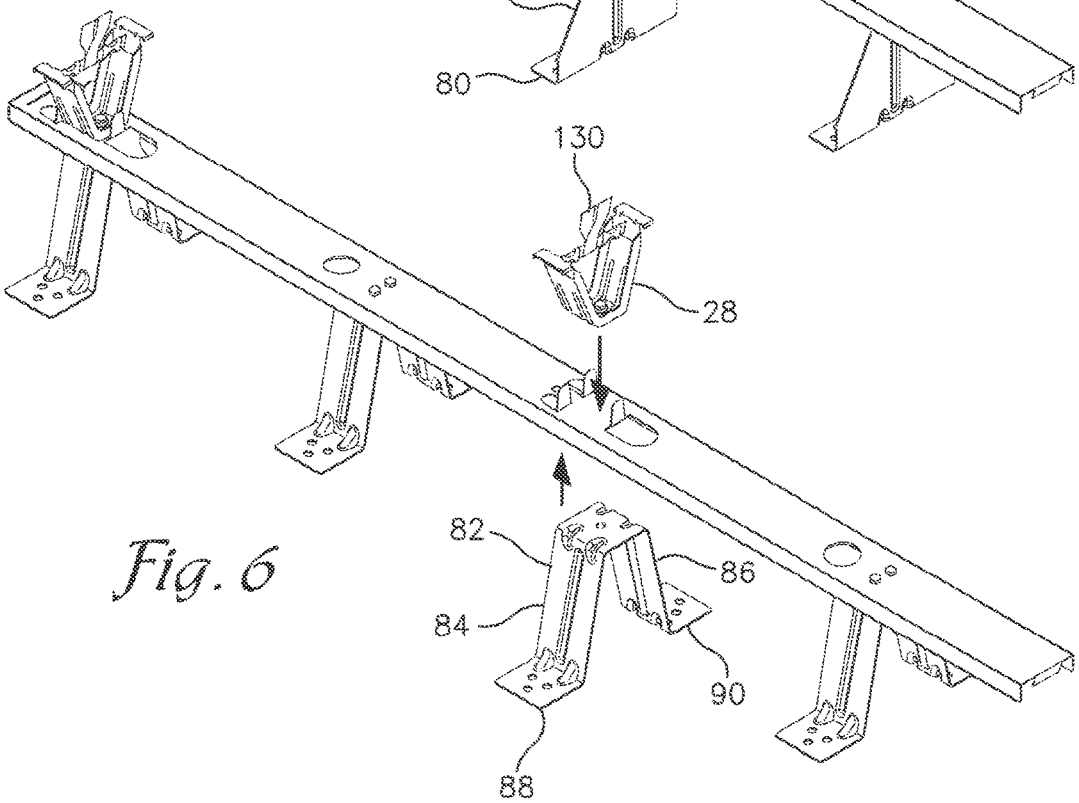
FIG. 6 a perspective view of components of an embodiment of the disclosed insulating system.

FIG. 3 reveals the first embodiment of the bridge bracket 32, also shown in FIG. 2, while FIG. 4 reveals a second embodiment of the bracket 60 that includes two connecting spans 66, 68. This embodiment includes a lower flange 62 with a plurality of openings 64 as well as two horizontal upper flanges 70, 72. This embodiment can provide increased crush resistance as compared to the embodiment shown in FIG. 3, for the roof when heavy loads, from snow, are anticipated. FIG. 4 also reveals a bridge 30 with upwardly extending tabs 140 that ensure the roof clips 28 are positioned so that a fastener passes through the base 126 of the roof clip 28, the bridge 30 and then the upper flange 42 of the bracket 32. FIG. 5 reveals a third embodiment of the bridge bracket 74 that is triangular in shape for mounting to a wide upper flange 34 of a purlin 18. This embodiment provides additional load carrying capacity as compared to the first bracket embodiment 32. This third bracket embodiment 74 includes a triangular connecting span 76 along with upper and lower flanges 78, 80 for mounting to the bridge 30 with threaded fasteners and to the purlin upper flange 34 at the bridge bracket's lower flange 80. A fourth embodiment is shown in FIG. 6 and details a bracket 82 with a bipod configuration. Two legs 84, 86 support the bracket 82 and are fabricated with side flanges 88, 90 that are secured to the upper flange of a purlin 18 (not shown).

In lieu of metal brackets, as discussed immediately above, an alternative to separating the bridge 30 and providing space for placement of the rolled insulation, which retains the roof clip 28 in position, from the purlins 18 is an insulating block, also generically referred to as a spacer member. Insulating blocks are preferably fabricated from high quality insulating materials, such as ASTM C578-Type VI extruded polystyrene. As seen in FIG. 10, the insulating blocks, 96, 104 which can be of any specified height, are positioned atop the first layer of insulation 116, thereby causing localized deformation of the rolled insulation, which is placed over the upper flange 34 of the purlin 18. Atop the insulating block 96 rests the metal bridge 30. Atop the bridge 30 is laid a second layer of insulation 124 that is locally compressed by the base 126 of the roof clip 28.

Figures 7, 8, 9:
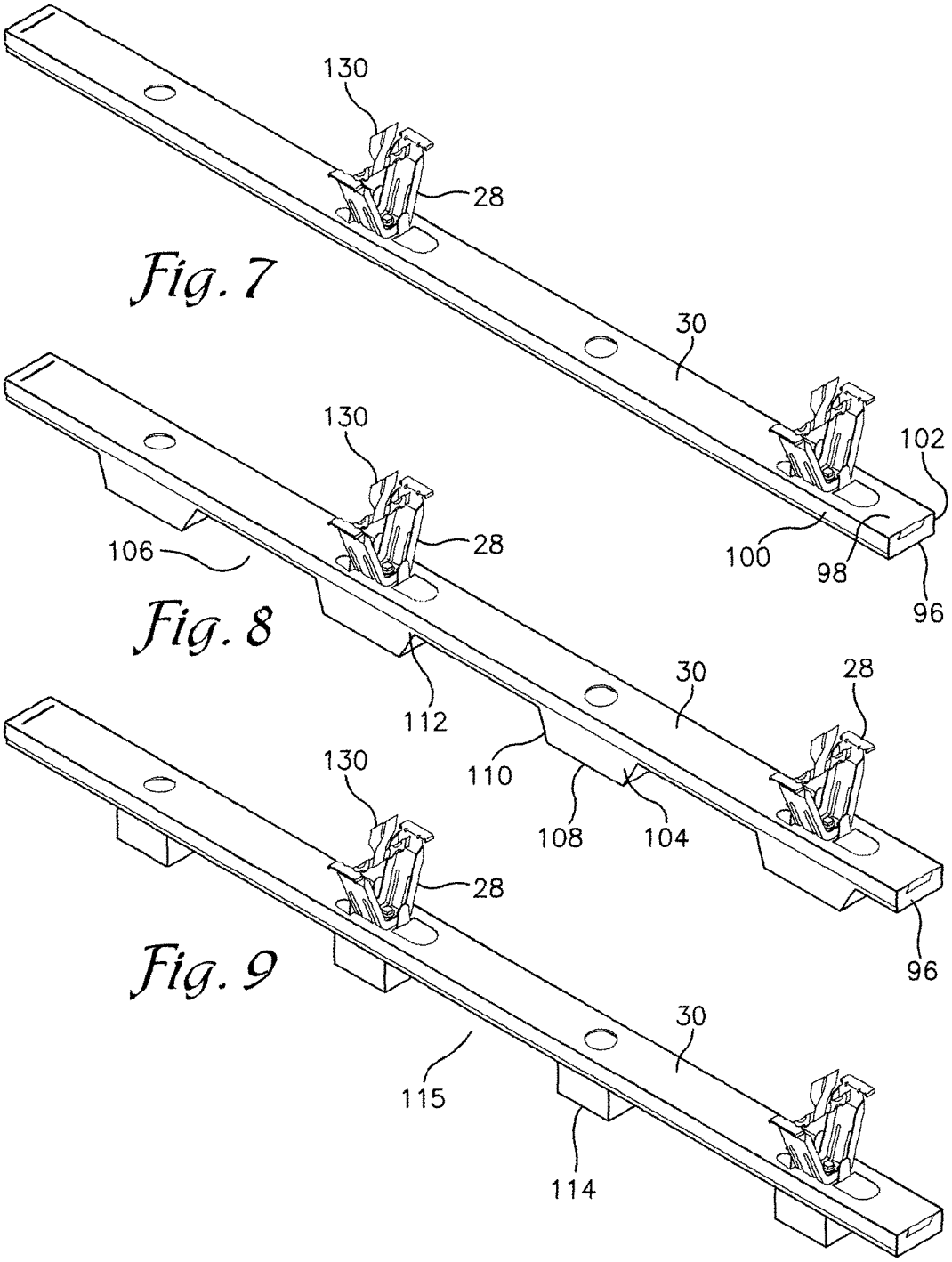
FIG. 7 a perspective view of components of an embodiment of the disclosed insulating system.
FIG. 8 a perspective view of components of an embodiment of the disclosed insulating system.
FIG. 9 a perspective view of components of an embodiment of the disclosed insulating system.

FIG. 7 details an embodiment of a portion of the insulating system 10 employing a plurality of clips 28 secured through a standard metal bridge 30 to other features of the insulating system and into the structural elements of the building. Also shown in FIG. 7 is an insulating element 96 disposed beneath the metal bridge 30 and effectively surrounded on three sides by the top surface 98 of the bridge as well as the two side surfaces 100, 102. The insulating element 96 is preferably comprised of a foam type material with very low heat transfer characteristics but also possessing a sufficiently high resistance to compressive loads. An exemplary insulating element 96 is fabricated from extruded polystyrene satisfying the requirements of ASTM C578-Type VI to include approximately a 40 psi compressive strength and a thermal resistance of R-5/inch. Other materials with comparable characteristics may also satisfy the operational requirements for the insulating system 10.

FIG. 8 details yet another configuration of the insulating system shown in FIG. 7. This portion of the insulating system details a plurality of blocks 104 disposed beneath and monolithic with the insulating element 96. The blocks 104 are configured to extend downwardly on an intermittent basis providing gaps 106 for through passage of insulation (not shown). FIG. 8 reveals an insulating block 104 with a flat bottom 108 and canted sides 110. The flat bottom 108 of the insulating block 104 will rest against and compress a layer of rolled insulation that is positioned over the upper flange 34 of a purlin 18. The upper surface 112 of the insulating block 104 will rest against a lower surface of the insulating element 96.

In the embodiment detailed in FIG. 9, block 114 comprises a rectangular configuration. The rectangular insulating blocks 114 are of a lesser dimension than the block embodiment 104 detailed in FIG. 8 and locally compress less of the rolled insulation; however, the block embodiment shown in FIG. 9 also has a reduced capacity to carry roof loads due to the lesser footprint surface area of the insulating blocks 114. Likewise, the insulating blocks 114 are intermittently disposed providing gaps 115 for through passage of uncompressed insulation (not shown).

FIG. 10 reveals a cross sectional view of the insulating system 10. The cross sectional view shown in FIG. 10 reveals a purlin 18 with an upper flange 34. Positioned atop the upper flange 34 is a rolled layer of insulation 116. This insulation preferably has thermal resistance of at least R-19 and preferably employs a downward looking face layer 118. The layer of insulation 116 is positioned between the flange 34 of the purlin 18 and the bottom surface 120 of the insulating block 104. Positioned atop and also covering the two sides 100, 102 of the insulating element 96 is the metal bridge 30.

Positioned atop the upper surface 98 of the metal bridge is a second layer of insulation 124. This layer of insulation preferably has a thermal resistance equivalent to at least R-25. The layer of insulation 124 experiences localized compression between the base 126 of the clip 28 and the top surface 98 of the metal bridge 30 and to a lesser extent immediately adjacent the base 126. The entire assembly of dual layers of insulation 116, 124, insulating block 108 and insulating element 96 is secured in position by passing a threaded fastener 47 through the base 126 the upper layer of insulation 124, the insulating element 96 the block 104, the lower layer of insulation 116 and into the upper flange 34 of the purlin 18. When these components are fully installed as detailed above the roof panels 16 are secured to the roof clip tab 130 of the roof clip 28 to complete the roof installation.

Importantly, in place of the insulating block 104 and the insulating element 96 shown in FIG. 10, the brackets 32, 60, 74, 82 may be employed to provide separation between the upper flange 34 of the purlin 18 and the base 126 of the clip 28. As previously discussed, the brackets 32, 60, 74, 82 may be of many different configurations and sizes to accommodate the desired thermal characteristics of the building.

FIG. 11 details a perspective view of the insulating system 10 fully configured atop a building with the roof panels 16 secured in position. FIG. 11 details the purlins 18 in position as roof structural features. Resting atop the upper flange 34 of the purlin 18 is the lower layer of insulation 116. Resting atop the lower layer of insulation are intermittently spaced insulating blocks 134. The blocks 134 depicted in FIG. 11 utilize a triangular configuration that minimizes the amount of surface contact with the lower insulation layer 116. This narrow line contact between the block 134 and the insulation serves to minimize the heat conduction path and increase the thermal efficiency of the building. Monolithic with, and disposed atop the insulating block 134, is the insulating element 96 that can vary in thickness from less than inch to several inches depending upon the desired thermal efficiencies of the building.

Resting atop the insulating element 96 is the metal bridge 30 that provides further structural support to the insulating system 10. The upper layer of rolled insulation 124 is positioned atop the metal bridge 30 and is rolled in a direction perpendicular to the purlin orientation, as best seen in FIG. 11. The roof clip 28 fastener 47 passes through the upper insulation 124, the metal bridge 30, insulating element 96, insulating block 134 and lower insulation 116 and is secured to the purlin flange 34.

Figure 12:
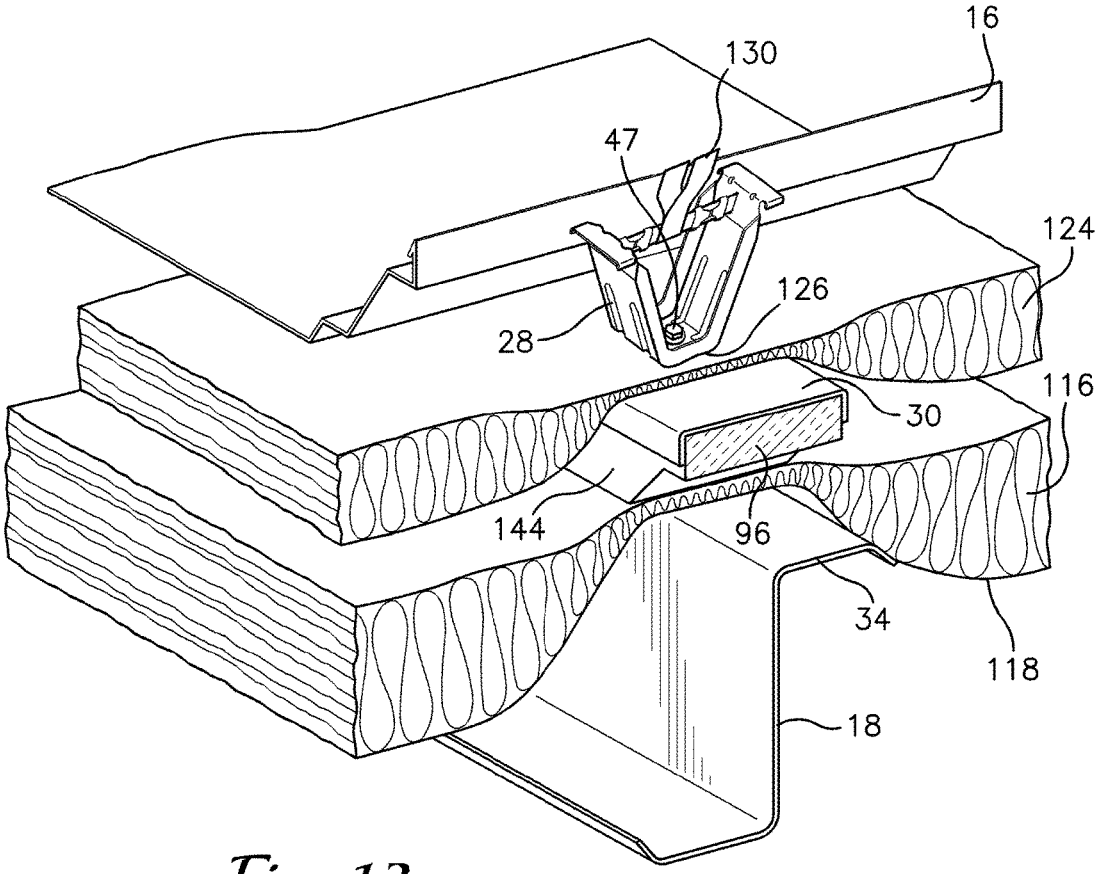
FIG. 12 is a perspective view of an embodiment of the disclosed insulating system.

FIG. 12 provides another perspective view of the insulating system 10 showing the standing seam roof panels 16 engaged with the roof clip 28 and also detailing the two layers of insulation 116, 124, the metal bridge 30, the insulating element 96 and the insulating block 144. FIG. 13 provides a perspective view of the insulating system 10 being installed. As detailed in FIG. 13, the metal bridge 30 utilizes basic Z-shaped brackets 32. The brackets 32 are preferably attached to the underside of the metal bridge 30 during fabrication by welding or other means of mechanical fastening and come as an assembled unit in various bridge lengths with a four foot length being standard. As seen in FIG. 13, some bridges 30 utilizes a plurality of upwardly extending tabs 140 for quick and accurate placement of the roof clip 28 and to facilitate securing the roof clip 28, the bridge 30 and the upper flange 42 of the bracket 32 together by passing a fastener through all three aligned components. Because the metal bridge 30 will often be overlain with the upper insulation layer 124 the installer may have difficulty locating the precise attachment point for the roof clip 28. The tabs 140 allow for a precise methodology for alignment of the clips so that the roof clips 28 are located directly above the bridge supports (be they insulating blocks or metal brackets) and the roof panels 16 remain fully aligned across the span of the roof.

The above discussion is directed to the installation of an insulating system to roof of the structure but is equally applicable to the walls of a structure. The description set forth above and as further detailed below should not be construed as limiting the applicability of the insulating system to just roof structures. The disclosed system is also fully capable of insulating a wall of a structure that does not employ a girt but instead utilizes a substrate such as wood. The same insulating block or bracket system is secured to the building substrate and ultimately secured to a wall or roof panel and the disclosed system should not be viewed as constrained to metal pre-fabricated building components. The same insulating block or bracket system may be used to retrofit or reroof an existing building, and may not be secured directly to an existing roof deck or structural system.

The description of the installation of the insulating system 10 begins with a roof structure that is comprised of bare purlins 18. A layer of rolled insulation 116, preferably with facing layer 118, is laid transversely across the purlins 18. Next, depending upon the specifications of the building owner, a bracket 32 embodiment or an insulating block 104, 114 embodiment is selected. An exemplary embodiment of a bracket assembly, as seen in FIG. 3 is comprised of a bridge 30 with brackets 32 pre-welded or fastened with other mechanical means to the underside of the bridge 30 at the upper flange 42 of the bracket. The bracket also includes a lower flange 38 that extends outwardly and includes a plurality of holes for anchoring the bracket to the purlin 18. The bridge with the plurality of intermittently spaced brackets 32 is positioned atop the layer of insulation 116 and locally compresses the insulation adjacent the brackets. Just beyond the lower flange 38 the insulation quickly expands to full thickness and also maximum thermal resistance until, moving laterally along the rolled insulation, the next bracket 32 is encountered where the insulation is again locally compressed. As best seen in FIG. 13, to secure the brackets 32 and bridge 30 to the upper flange 34 of the purlin at least one threaded fastener 54 is passed through the lower flange 38, through the insulating layer 116 and into the upper flange 34 of the purlin. A power drill 48 is preferably employed with a long extension 46 and a socket 52 for efficiently rotating the threaded fastener 44 through the upper flange 34 of the purlin 18. This process is repeated as necessary to secure all of the brackets 32 to the purlin flange 34.

To span the entire roofing structure multiple bridge or bracket assemblies may be required. As seen in FIG. 4 each bridge is fabricated with a tab 152 at one end and a slot 150 at the opposite end. The tab 152 of a first bridge engages the slot 150 of a second adjacent bridge tying the two bridges together and providing for a highly linear path for the roofing panels 16 when ultimately installed.

Once the bridge and bracket assemblies are installed a second layer of insulation 124 is laid transversely over the bridge 30. This layer of insulation is preferably unfaced. Once this layer of insulation is in position the installer then manually locates the upwardly extending tabs 140 which may require the installer to manually relocate the insulation proximate the tabs 140. The installer is clearing an opening for placement of the clip 28. The bridge will preferably have a total of three tabs 140 at each location where the roof clip 28 is to be secured. The three tabs 140 positively locate the roof clip 28 and also prevent undesired rotation of the clip 28 that could create installation challenges when the roof clips are secured to the roof panels 16. The three tabs 140, as discussed above, also facilitate alignment of the through holes in the base 126 of the clip 28 with the hole in the upper flange 42 of the bracket 32 which is disposed directly beneath the bridge 30. A threaded fastener 47, as seen in FIG. 13 is then passed through the base 126 of the roof clip 28. The threaded fastener 47 extends through the bridge 30 thereby securing the roof clip 28 to the top flange 42 of the bracket 32 which in turn is secured to the upper flange 34 of the purlin 18.

Once the clips 28 are in position the roof panels are then laid in position over the second or upper layer of insulation 124. Alternatively an insulating spacer block may be applied over the secondary layer of insulation at the bridge locations adding a thermal resistance and support for the panel. The roof panels are then seamed along with the roof panel tabs 130 in position. This roof structure is configured to resist the transfer of heat and is also water resistant.

As an alternative to the use of the bracket 32 configuration, as disclosed in FIG. 10, insulating blocks may be employed immediately above the first layer of insulation 116. The insulating blocks 104 and insulating element 96 are preferably monolithic in configuration but may optionally be separate and combined as specified. As the insulating blocks 104 are placed atop the insulation 116, the insulation locally compresses adjacent the insulating blocks and expands a short distance away from the blocks returning to full thickness and thermal resistance. The insulating blocks, where the insulation is fully compressed atop the purlin upper flange 34, serve to minimize the transfer of heat and increase the thermal efficiency of the roof or wall structure.

The insulating block 104 and insulating element 96 and bridge 30 are then covered by a second layer of insulation 124 and the roof clip 28 with associated panel clip tab 130 are positioned atop the bridge thereby locally compressing the second insulation layer 124. The installer, as detailed above, must then pass a threaded fastener 47 through the bridge 30, the base 126 of the roof clip 28, through the insulating element 96 and insulating block 104 and into the upper flange 34 of the purlin 18. The threaded fasteners effectively secure the insulating system 10 to the purlins 18 of the structure. Once the roof clips 28 are in position the roof panel tab 130 may be integrated into the standing seam roof of the structure as is commonly performed in the industry, Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and sub-combinations are of utility and may be employed without reference to other features and sub-combinations and are contemplated within the scope of the claims. Not all steps listed in the various figures need be carried out in the specific order described.

We claim:

1. An insulating system for the roof and walls of a building, the insulating system comprising:

a plurality of longitudinally extending purlins, girts or upper chords of a building truss or deck;

a first layer of insulating material extending transversely across the longitudinally extending purlins, girts or upper chords of a building truss or deck;

a plurality of longitudinally extending bridge members each with an upper and a lower surface and spaced apart through holes;

a plurality of spacer members, each spacer member having at least one upper and one lower flange and at least one connecting member disposed between the upper and lower flanges, wherein the upper and lower flanges each extend substantially perpendicular to the connecting member, the upper flange connected to and extending downwardly from the lower surface of the bridge members wherein the at least one lower flange locally compresses the first layer of insulating material proximate to the at least one lower flange allowing an otherwise uncompressed first insulation layer to extend between the spacer members;

a second layer of insulating material extending transversely across the upper surface of the bridge member; and a plurality of panel clips each with a base and a panel clip tab disposed opposite the base, the panel clips disposed atop and locally compressing the second layer of insulation, and the panel clip tab engages with roof or wall panels in the formation of a water resistant seam.

2. The insulating system of claim 1, wherein the spaced apart through holes in the bridge members provide access for an installer's drill shank and socket beneath the bridge members in order to drive a fastener through the lower flange of the spacer member and into an upper flange of the purlin, girt or upper chord.

3. The insulating system of claim 1, wherein the orthogonally extending spacer members include at least one stiffening gusset at a junction between the upper flange and the connecting member and at least one stiffening gusset at the junction between the lower flange and the connecting member.

4. The insulating system of claim 1, wherein the spacer member further comprises two connecting members, two upper flanges and a single lower flange.

5. The insulating system of claim 1, wherein the spacer member further comprises at least two connecting members separated and joined by a lower flange and wherein each connecting member is also joined to an upper flange.

6. The insulating system of claim 1, wherein the spacer member further comprises a triangular shaped connecting member with an upper and lower flange extending outwardly from the connecting member.

7. The insulating system of claim 1, wherein the spacer member further comprises dual connecting members each with a separate upper flange and a lower flange joining the dual connecting members.

8. The insulating system of claim 1, wherein the spacer members are fabricated from a structural grade steel.

9. The insulating system of claim 1, wherein the spacer members are fabricated from an engineered plastic.

10. The insulating system of claim 1, wherein the spacer members are fabricated from an engineered composite.

* * * * *